US005680667A

United States Patent [19]

Kresse et al.

[11] Patent Number: 5,680,667

[45] Date of Patent: Oct. 28, 1997

[54] HEAD FOR A FLOOR-CLEANING MOP

[75] Inventors: Franz Kresse, Hilden; Rainer Osberghaus, Duesseldorf; Hans-Leo Fernschild, Korschenbroich; Gerhard Ostwald, Essen, all of Germany

[73] Assignee: Henkel-Ecolab GmbH & Co. OHG, Duesseldorf, Germany

[21] Appl. No.: 615,208

[22] PCT Filed: Sep. 1, 1994

[86] PCT No.: PCT/EP94/02902

§ 371 Date: May 9, 1996

§ 102(e) Date: May 9, 1996

[87] PCT Pub. No.: WO95/07047

PCT Pub. Date: Mar. 16, 1995

[30] Foreign Application Priority Data

Sep. 9, 1993 [DE] Germany ..... 43 30 493.1

[51] Int. Cl.[6] ..... A47L 13/20

[52] U.S. Cl. ..... 15/229.8; 15/229.4

[58] Field of Search ..... 15/229.1, 229.2, 15/229.4, 229.6, 229.8

[56] References Cited

U.S. PATENT DOCUMENTS

| | | | |
|---|---|---|---|
| 4,382,310 | 5/1983 | Moss . | |
| 4,715,081 | 12/1987 | Welch . | |
| 4,914,778 | 4/1990 | Thompson . | |
| 4,961,242 | 10/1990 | Kresse et al. . | |
| 5,253,387 | 10/1993 | Kresse et al. | 15/229.8 |
| 5,315,734 | 5/1994 | Kresse et al. | 15/229.8 |
| 5,398,492 | 3/1995 | Thomas | 15/229.1 |
| 5,452,491 | 9/1995 | Thompson | 15/229.8 |

FOREIGN PATENT DOCUMENTS

| | | |
|---|---|---|
| 3809279 | 7/1989 | Germany . |
| 4022326 | 1/1992 | Germany . |
| 4025646 | 5/1992 | Germany . |
| 2017020 | 1/1990 | Japan . |

*Primary Examiner*—David Scherbel
*Assistant Examiner*—Terrence Till
*Attorney, Agent, or Firm*—Ernest G. Szoke; Wayne C. Jaeschke; Kenneth Watov

[57] ABSTRACT

A floor-cleaning mop head includes an oblong textile base fabric with, attached to the top at both ends, slide-in pockets for the head-holder and, attached underneath, material designed to collect moisture and dirt in the form of hair tufts, fringes, loops, foam-rubber strips, and so forth. The oblong base fabric consists, at least in the zone of the slide-in pockets, of a material which is more highly heat-shrinking than the textile material of which the pockets are made, in order to ensure that the pockets on top of mop remain open even after repeated washing of the mop head, without effecting other useful characteristics of the mop.

5 Claims, 1 Drawing Sheet

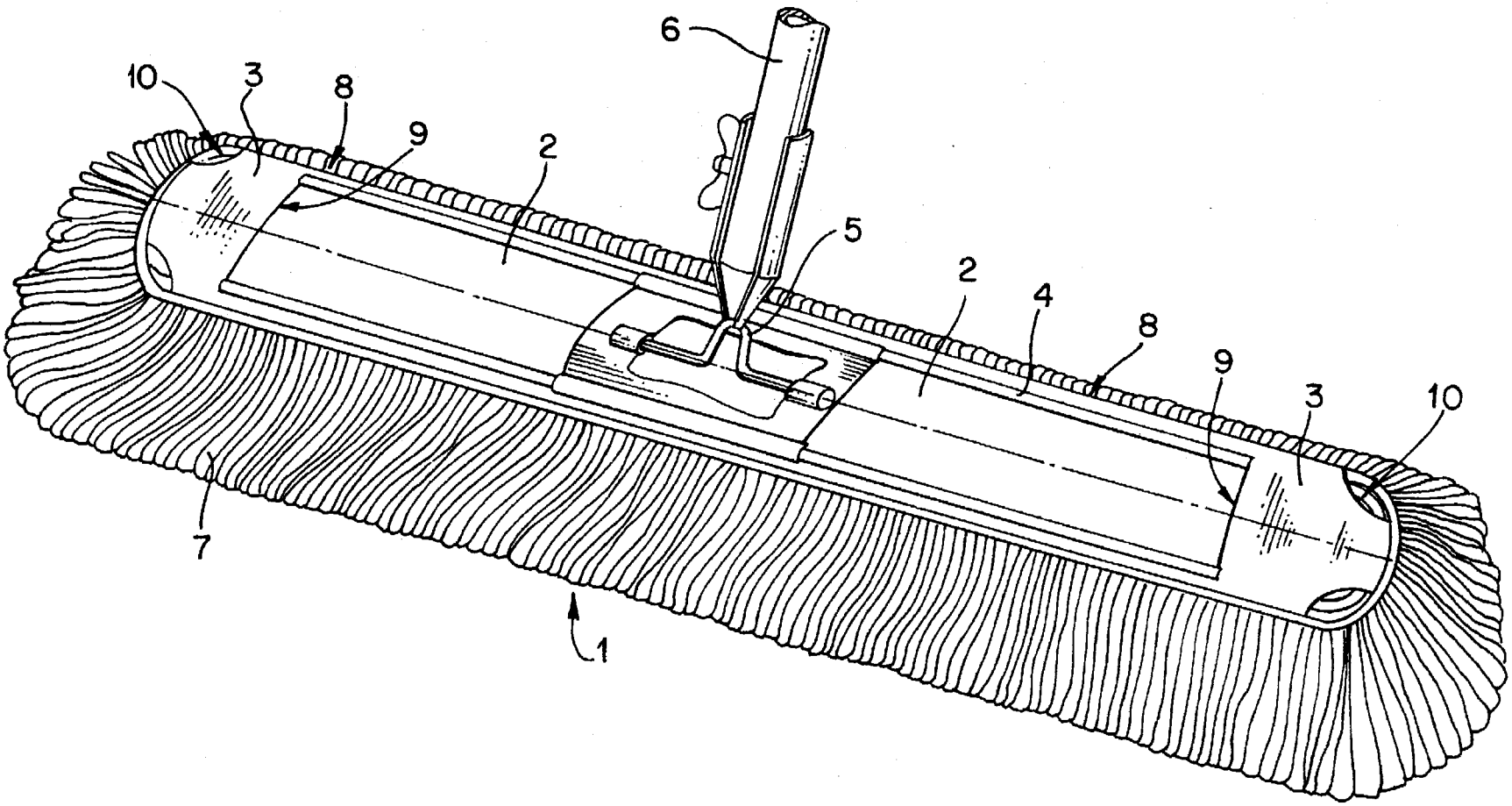
10
3
9
8
4
2
5
6
2
9
8
3
10
1
7

HEAD FOR A FLOOR-CLEANING MOP

BACKGROUND 1.0 Field of the Invention

This invention relates generally to mop heads, and more specifically to a mop head for cleaning floors comprising an elongate textile carrier with holder insertion pockets arranged on top of the carrier at either end thereof and material arranged underneath for taking up dirt and moisture in the form of shaggy strands, fringes, loops, strips of sponge cloth or the like.

2.0 Discussion of Related Art

Mop heads in the field of the invention are used for cleaning floors, for which purpose the mop heads are fitted onto holders. The ends of the holders are inserted into the holder insertion pockets. The holders have a handle so that the holders with the mop head fitted thereon can be conveniently moved over the floors to be cleaned.

A mop head as defined in the preamble, in which the holder insertion pockets can be formed from a textile material, is known from DE-PS 38 09 279. Unfortunately, a mop head such as this can only be inserted into the holder insertion pockets when the pockets have been opened or stand open. However, since the mop heads are frequently passed through presses to remove water and are also regularly washed and cleaned in washing machines, the pockets do not stand open, but instead lie flat on the textile carrier. To be able to introduce the holder, therefore, the pockets have first to be opened out by hand.

In order to remedy this situation, other known mop heads are provided with reinforcements in the form of inserted stiff plastic strips or similar elements in the vicinity of the pocket openings. These plastic strips or the like are sewn into the holder insertion pockets. Unfortunately, reinforcements such as these have a number of disadvantages. Firstly, the stiff strips used cause problems when the mop heads are wrung out in mangles. The mop heads often jam between the rollers of the mangle. In many cases, reinforcing strips of plastic have often been destroyed so that they are no longer capable of performing their function of keeping the pockets open. In addition, known solutions have disadvantages in regard to the cleaning, i.e. washing, of the mop heads. The reinforced areas interfere with the tumbling process where the mop heads are washed in washing machines. Also, the stiff inserts and pockets rub against the textile carrier during washing and thus lead to premature destruction of the mop head. Moreover, the weight of the machine load is increased by the reinforcements because the holder insertion pockets are now heavier.

In addition, in another known mop head developed by applicants (DE-PS 40 25 646), the holder insertion pockets comprise strips of a water-absorbing and swellable material in the vicinity of the pocket opening. Before a mop head such as this is used for the first time, the dry strips consisting of water-absorbing and/or swellable material come into contact with and take up liquid so that the strips increase in volume via expansion. This ensures that the holder insertion pockets are automatically opened or kept open, the water-absorbing and/or swellable strips remain elastic so that they do not have the disadvantages of the other known solutions described above.

However, it has been found that, with a mop head of this type, the holder insertion pockets are not always automatically kept open after repeated washing because when the pockets equipped with the particular strips are sewn onto the carrier material, it is only possible to arrange the pockets in such a way that they are slightly raised. As a result, the holder fits the particular pocket opening almost exactly. Since the pocket/carrier material shrinks where washing is carried out at temperatures of around 60° C., it has been found to be difficult to insert the holder into the pockets after washing.

3.0. Summary of the Invention

Accordingly, an object of the present invention is to provide a solution which ensure that the pockets remain open, even after repeated washing of the mop head, without adversely affecting the other performance properties of the mop head.

With this and other objects in mind, one embodiment of the invention includes by making the elongate carrier, at least in the region of the holder insertion pockets, of a material which undergoes greater shrinkage on heating than the textile material of the holder insertion pockets.

By virtue of this embodiment of the mop head according to the invention, the automatic maintenance for keeping open the holder insertion pockets is further improved by repeated washing of the mop head. This is because the material of the carrier shrinks to a greater extent than the material of the pockets through washing so that the pockets inevitably undergo additional "arching", i.e. the pocket opens automatically and additionally through the difference in shrinkage behavior which clearly benefits insertion of the holder. At the same time, production of the mop head is also made easier because there is no longer any need for additional elements in the form of plastic strips or water-absorbing and/or swellable strips which have to be sewn to the pockets. Since both the material of the pockets and the material of the carrier are elastic, the tumbling process in washing machines is not impeded and the heads are also not subsequently misshapen in mangles. In addition, the blended material of the carrier is absorbent so that the carrier also takes part in the cleaning process.

In one particularly advantageous embodiment of the invention, the carrier consists of a cotton/synthetic blend while the holder insertion pockets consist of a fully synthetic fabric. The blend used for the carrier should be selected to ensure a sufficient difference in shrinkage behaviour between the carrier and pocket material.

The carrier material preferably consists of a cotton/polyester, cotton/polyamide or even cotton/polypropylene blend.

The synthetic material for the holder insertion pockets preferably consists of polyester, although basically other materials may be used. However, polyester pockets are particularly durable and inactive in terms of cleaning.

If, for example, the blend used for the carrier consists of 65% polyester and 35% cotton and the synthetic used for the pockets consists of polyester, it has been found that, after a mop head according to the invention has been washed five times at 60° C., the carrier material shrinks by 4%, whereas the pockets shrink by only 1%, resulting in the required "stay-open" effect through arching of the pockets.

BRIEF DESCRIPTION OF THE DRAWING

An example of one embodiment of the invention is described in detail in the following with reference to the accompanying drawing which is a perspective view of a mop head according to the invention, and in which like items are indicated by the same reference designation.

A flat mop head according to the invention is generally denoted by the reference 1 in the drawing. The mop head 1 comprises an elongate textile carrier 2 onto the top of which a holder insertion pocket 3 is sewn at either end to receive a holder 4. The holder 4 is connected to a handle 6 in known manner by a universal joint 5.

Whereas the holder insertion pockets 3 consist of a fully synthetic fabric, for example polyester, the carrier 2 consists of a cotton/synthetic blend which shrinks to a greater extent than the synthetic fabric used for the holder insertion pockets 3 under the effect of heat, particularly in a washing machine.

On its underside, i.e. on its "cleaning-active" side, the textile material 2 has a plurality of strips or fringes 7 of sponge cloth or the like arranged adjacent one another, the outer edge of the carrier 2 being provided with a surrounding binding tape 8.

The insertion openings of the holder insertion pockets 3 are denoted by the reference 9. The holder insertion pockets 3 preferably have water outlet openings 10 at their other ends.

In one particularly preferred embodiment of the mop head 1 according to the invention, the textile carrier 2 consists of a 65% polyester/35% cotton blend, while the holder insertion pockets 3 are made of 100% polyester. This combination of different materials for the pockets 3 and the carrier 2 provides for different shrinkage behavior during washing of the mop head 1. For example, it has been found that, after washing 5 times at 60° C., the carrier material 2 shrinks by 4%, whereas the holder insertion pockets 3 shrink by only 1%. This difference in shrinkage behavior automatically results in arching of they so that the pockets 3 are automatically kept open, leaving the pocket insertion openings 9 free for insertion of the holder 4.

The invention is by no means confined to the illustrated embodiment and may be modified in other ways without departing from the basic concept, which modifications are meant to be covered by the spirit and scope of the appended claims. For example, other materials can be used for the pockets 3 and the carrier 2, although the material selected for the carrier 2 must shrink to a greater extent than the material of the pockets 3 on exposure to heat during washing.

What is claimed is:

1. A mop head for cleaning floors comprising an elongated textile carrier having top and bottom surfaces, with holder insertion pockets arranged on the top of the carrier at either end thereof, said pockets made of a textile material, and material arranged on the bottom for taking up dirt and moisture, the material consisting of one of shaggy strands, fringes, loops, strips of sponge, or cloth, wherein the improvement comprises the elongated carrier, at least in the region of the holder insertion pockets, consists of a material which undergoes greater thermal shrinkage than the textile material of the holder insertion pockets.

2. A mop head as claimed in claim 1, wherein the carrier consists of a cotton/synthetic blend, and the holder insertion pockets consist of a fully synthetic fabric.

3. A mop head as claimed in claim 2, wherein the holder insertion pockets consist of polyester.

4. A mop head as claimed in claim 2, wherein the carrier material consists of one of a cotton/polyester blend, a cotton/polyamide blend, or a cotton/polypropylene blend.

5. A mop head as claimed in claim 1, wherein the carrier material consists of one of a cotton/polyester blend, a cotton/polyamide blend, or a cotton/polypropylene blend.

* * * * *